US008674252B2

(12) United States Patent
Tresse et al.

(10) Patent No.: US 8,674,252 B2
(45) Date of Patent: Mar. 18, 2014

(54) METHOD OF OPTIMIZING A PROCESS FOR HANDLING AND TRANSPORTING MAIL IN BINS USING LAYERED SORTING

(75) Inventors: Didier Tresse, Saint Laurent d'Onay (FR); Nicolas Basset, Saint Paul Trois Chateaux (FR); Jacques Petit, Bourg les Valence (FR)

(73) Assignee: Solystic, Gentilly, Cedex (FR)

( * ) Notice: Subject to any disclaimer, the term of this patent is extended or adjusted under 35 U.S.C. 154(b) by 271 days.

(21) Appl. No.: 13/142,070

(22) PCT Filed: Mar. 15, 2011

(86) PCT No.: PCT/FR2011/050521

§ 371 (c)(1), (2), (4) Date: Jun. 24, 2011

(87) PCT Pub. No.: WO2011/141651

PCT Pub. Date: Nov. 17, 2011

(65) Prior Publication Data

US 2012/0067790 A1 Mar. 22, 2012

(30) Foreign Application Priority Data

May 10, 2010 (FR) ..... 10 53626

(51) Int. Cl.
*B07C 3/00* (2006.01)

(52) U.S. Cl.
USPC ..... 209/584; 209/583; 209/900

(58) Field of Classification Search
USPC ..... 209/509, 583, 584, 900
See application file for complete search history.

(56) References Cited

U.S. PATENT DOCUMENTS

| | | | | |
|---|---|---|---|---|
| 5,994,657 | A * | 11/1999 | Maier et al. | 209/584 |
| 6,227,378 | B1 * | 5/2001 | Jones et al. | 209/698 |
| 6,576,857 | B1 * | 6/2003 | De Leo et al. | 209/584 |
| 2003/0155283 | A1 * | 8/2003 | Boensch | 209/584 |
| 2004/0040898 | A1 | 3/2004 | Kechel | |
| 2005/0045531 | A1 | 3/2005 | Bretschneider et al. | |
| 2006/0283784 | A1 | 12/2006 | Roth et al. | |

FOREIGN PATENT DOCUMENTS

EP 10310760 B3 9/2004

* cited by examiner

*Primary Examiner* — Terrell Matthews
(74) *Attorney, Agent, or Firm* — Rothwell, Figg, Ernst & Manbeck, P.C.

(57) ABSTRACT

The invention relates to a method of optimizing a process for handling mail, which method comprises the following steps: subjecting mailpieces to a first machine-sorting cycle in which a plurality of first sorting outlets are allocated to respective ones of a plurality of first delivery destinations having high rates of filling and one other sorting outlet is allocated to second delivery destinations having low rates of filling; directing separators to the first sorting outlets; recirculating the mailpieces coming from the other sorting outlet; and subjecting them to a second sorting cycle in which the first sorting outlets are allocated to the second delivery destinations. If the sorting outlets use storage bins, at the end of the second sorting cycle, the mailpieces of a first destination and the mailpieces of a second destination are sorted in layers in the same bin by being separated by a separator.

7 Claims, 3 Drawing Sheets

METHOD OF OPTIMIZING A PROCESS FOR HANDLING AND TRANSPORTING MAIL IN BINS USING LAYERED SORTING

CROSS-REFERENCE TO RELATED APPLICATIONS

This application is a 35 U.S.C. §371 National Phase Entry Application from PCT/FR2011/050521, filed Mar. 15, 2011, and designating the United States, which claims the benefit of France Patent Application No. 1053626, filed May 10, 2010, the disclosures of which are incorporated herein in their entirety by reference.

TECHNICAL FIELD

The invention relates to the field of postal sorting, and more particularly to the field of sorting mail automatically, whereby mailpieces are collected and sorted in a first mail handling center and are then transported in storage bins to second mail handling centers in communication with the first mail handling center, and whereby the mail sorting in the first center consists in separating the mailpieces in a sorting machine having a plurality of sorting outlets, each of which uses at least one storage bin so as to form a certain number of groups of storage bins in which the mailpieces are stored, the groups of storage bins being for respective ones of said second mail handling centers, and whereby the sorting machine is controlled by one or more sorting cycles so as to segment each group of storage bins that are for a second mail handling center in such a manner as to distinguish between the mailpieces stored in said bins depending on a plurality of delivery destinations associated with said second mail handling center.

PRIOR ART

The invention relates more particularly to a method of optimizing the filling of the bins in such a process for handling mail, in particular when the mailpieces are collected and sorted in an "outward" sorting center at which "outward" sorting or "routing" sorting is performed and from which they are transported, in particular by air, road, or rail, in storage bins, to "inward" sorting centers at which "inward" sorting or "delivery" sorting is performed. In an inward sorting center, the mailpieces thus arrive in storage bins that are already pre-sorted by delivery destination, thereby making it possible to reduce the time necessary for performing the sorting process in the inward sorting center. Thus, outward sorting in the outward sorting center makes it possible to achieve pre-sorting, while inward sorting in the inward sorting center makes it possible to prepare the delivery round or "postman's walk".

Conventionally, a sorting machine receives as input a flow of mailpieces disposed in random order, and delivers as output an ordered flow of mailpieces, i.e. a flow of mailpieces disposed in a predetermined order. In outward sorting, the predetermined order substantially corresponds to separation by groups of delivery addresses. In inward sorting that is performed downstream from the outward sorting, the predetermined order thus corresponds to sequential delivery of the mailpieces by one or more mail carriers.

A plurality of inward sorting centers that are in mutual communication constitute a postal sorting cluster that can be distributed over a geographical zone that may be small or large, e.g. a national zone. In such a postal sorting cluster, each inward sorting center also constitutes an outward sorting center relative to the other inward sorting centers of the cluster.

In general, the sorting machines that are used in a postal sorting cluster for outward sorting purposes are equipped with a small number of sorting outlets due to cost and compactness constraints. Typically, such a sorting machine has about one hundred sorting outlets using removable storage bins in which the mailpieces are stored flat, for example. Each such storage bin has a storage capacity of about 50 mailpieces. Sorting the mailpieces in such a sorting machine may require a plurality of sorting passes and the volume of the mail to be handled may require several tens of storage bins per sorting outlet.

An outward sorting machine thus normally comprises: an unstacker magazine receiving a batch of mailpieces to be sorted such as large-format magazines or letters with or without paper or plastics wrappers or envelopes; a certain number of sorting outlets that are respectively fed with empty removable bins for storing the sorted mailpieces; and a sorting conveyor interposed between the unstacker magazine and the sorting outlets, and controlled by an electronic processor unit for directing each mailpiece to be sorted towards a respective sorting outlet on the basis of an identifier making it possible to determine the delivery destination code that is normally printed on the mailpiece, and on the basis of an allocation table stored in a memory in the electronic processor unit and correlating the code to a given sorting outlet of the machine.

In a conventional outward sorting process, groups of storage bins are constituted that comprise a large number of partially full bins since segmenting the bins into a group of bins for an inward sorting center generally takes place by changing bins in the sorting outlet in question of the machine. If it is assumed that several tens of delivery destinations can be associated with an inward sorting center, it is possible, at the end of the outward sorting process for each inward sorting center to have several tens of partially full storage bins. Such partially full storage bins take up space unnecessarily in the means for transporting the mail, thereby resulting in additional costs for operating the postal sorting cluster.

Over a plurality of sorting cycles in the machine, some mailpieces may be taken from the sorting outlets and placed at the inlet of the machine, and this may happen in repeated manner. In certain situations, the relationship between the maximum number of delivery destinations that a sorting machine can manage in a given sorting process, the number of sorting outlets available for the sorting process, and the number of sorting cycles in the sorting process can lead to inefficient use of the sorting machine. More particularly, such situations can arise when the number of delivery destinations to cover is hardly any greater than the maximum number of delivery destinations that can really be managed by the machine for a certain number of sorting cycles, and is considerably smaller than the maximum number of delivery destinations that can be managed with the sorting process using the next highest number of sorting cycles. Situations of that type can be managed either by increasing the number of sorting cycles, or by increasing the number of sorting outlets, or indeed by subdividing the batch of mailpieces into two or more subsets to be processed separately.

But those three solutions are unsatisfactory for various reasons. Increasing the number of sorting cycles in a sorting process is detrimental to good use of the machine and increases the time and the costs of the sorting process. Increasing the number of sorting outlets of the machine can also give rise to additional costs for manufacturing the machine and to a larger amount of space being necessary for storing it. In addition, that solution is not necessarily possible for sorting machines that have already been manufactured or installed. Finally, subdividing the batch of mailpieces into subsets can be incompatible with the needs of the end customer and, in any event, requires redefinition of all of the machine parameterization of the sorting process, which gives rise to additional costs and time.

Situations can also arise in which the number of delivery destinations to be managed is comparable to the maximum number of delivery destinations addressable in the sorting process for a given number of sorting cycles, but certain delivery destinations have a rate of filling that is so high that they can hinder use of sorting outlets during the various sorting cycles, thereby inevitably generating inefficient use of the machine.

SUMMARY OF THE INVENTION

An object of the invention is thus to propose a method of optimizing a mail handling process as indicated above by minimizing the number of bins to be transported from one postal sorting center to another postal sorting center while keeping the same level of separation of the mailpieces.

Another object of the invention is to propose such a method that aims to reduce the proportion of partially full bins at the end of outward sorting, in particular, without however being detrimental to efficient use of the sorting machines.

The invention stems from the observation that, in a sorting process, most (about 80%) of the mail is distributed over a few main delivery destinations (about 20% of the delivery destinations), the remainder of the mail being distributed over a large number of secondary other delivery destinations. It has therefore been found advantageous to take account of such differences in rates of filling (differences in volume of mail per destination) and to subdivide the sorting segment of the postal sorting machine into a first zone having a large number of sorting outlets for receiving the mailpieces having destinations that have high rates of filling, and into a second zone having a small number of sorting outlets for temporarily receiving the mailpieces having destinations that have low rates of filling.

The basic idea of the invention is thus to use the space available in the bins that are partially full of main-destination mailpieces and that are produced at the end of a first sorting cycle to store secondary-destination mailpieces during a second sorting cycle, the idea being that the mailpieces of the secondary destinations that are related to the main destination of a partially full bin are stored in that bin after inserting a physical separator therein.

The term "related" delivery destination is used to mean a destination for which mail is transported by the same means of transport as the means used for transporting the mail for the main destination. Better filling of the bins thus makes it possible to reduce the proportion of partially full bins and thus to reduce the overall number of bins that need to be transported.

The invention thus provides a method of optimizing a process for handling mail in a sorting machine, said method being characterized in that it comprises the following steps: subjecting mailpieces to a first machine-sorting cycle in which a plurality of first sorting outlets of the sorting machine are allocated to respective ones of a plurality of first delivery destinations and at least one other sorting outlet of the sorting machine is allocated to a plurality of second delivery destinations; directing separators for physically separating mailpieces through the sorting machine to respective ones of the first sorting outlets; and re-circulating to the inlet of the sorting machine the mailpieces coming from said other sorting outlet and subjecting them to a second sorting cycle in which the plurality of first sorting outlets are allocated to respective ones of the plurality of second delivery destinations.

If the sorting outlets automatically use storage bins that are interchangeable and removable, e.g. by using an automatic bin-manipulation system along each side of the row of sorting outlets of the sorting machine, at the end of the second sorting cycle, the mailpieces respectively of a main first destination and of a second destination related to said main destination find themselves sorted into layers in the same bin by being separated by a separator.

More particularly, the invention provides a method of optimizing a mail handling process, wherein mailpieces are collected and sorted in a first mail handling center so as to be transported in storage bins to M second mail handling centers in communication with the first mail handling center, the sorting of the mail in the first center consisting in separating the mailpieces in a sorting machine having N sorting outlets, each of which uses at least one storage bin so as to form M groups of storage bins in which the mailpieces are stored, these M groups of storage bins being for respective ones of said M second mail handling centers, and wherein the sorting machine is controlled by one or more sorting cycles so as to segment each group of storage bins for a second mail handling center in such a manner as to distinguish between the mailpieces stored in said bins as a function of a plurality of delivery destinations associated with said second mail handling center, said method being characterized in that it comprises the following steps:

a) preparing the sorting machine for a first sorting cycle for sorting the mailpieces, the sorting outlets of the sorting machine comprising a plurality of first sorting outlets and at least one second sorting outlet distinct from said first sorting outlets, the preparation consisting in:

a.1 allocating P first sorting outlets to respective ones of P first delivery destinations associated with a second mail handling center in question, and doing so for each second mail handling center with the condition M×P less than N, where P is greater than or equal to 1, the P first sorting outlets allocated to a second center being distinct from the P first sorting outlets allocated to another second mail handling center; and in a.2 allocating said second sorting center to M×P second delivery destinations associated with respective ones of M second mail handling centers;

b) subjecting the mailpieces to the first sorting cycle in the sorting machine so as to collect, in at least one storage bin at each first sorting outlet, mailpieces corresponding to a first delivery destination associated with a second mail handling center and, at the second sorting outlet, mailpieces corresponding to the M×P second delivery destinations;

c) inputting into the sorting machine M×P separators so as to place them in respective ones of the M×P storage bins being filled at respective ones of said first sorting outlets;

d) preparing the sorting machine for a second sorting cycle for sorting the mailpieces, the preparation consisting in:

d.1 allocating the M×P first sorting outlets of the sorting machine to respective ones of the M×P second delivery destinations associated with the M second mail handling centers; and in d.2 re-circulating into the inlet of the sorting machine the mailpieces received in the second sorting outlet during the first sorting cycle; and e) subjecting said re-circulated mailpieces to the second sorting cycle in the sorting machine so as to collect, in each storage bin being filled at each first sorting outlet, mailpieces corresponding to a second delivery destination, these mailpieces that correspond to a second delivery destination being separated from the mailpieces that correspond to a first delivery destination by a separator in said storage bin.

With the method of the invention for optimizing an automatic mail sorting process, at the end of the sorting process, at the most M×P partially full bins are produced. If the size of the sorting machine is such that additional sorting outlets are still available, the optimization method of the invention may advantageously have the following feature:

in step a.2), the preparation further consists in allocating a third sorting outlet to M×P third delivery destinations associated with respective ones of the M second mail handling centers; and in step b), the mailpieces are subjected to the first sorting cycle so as to collect, at said third sorting outlet, the mailpieces corresponding to the M×P third delivery destinations;

the following steps being implemented subsequently to step e):

f) inputting into the sorting machine M×P other separators so as to place them in respective ones of the M×P storage bins being filled at respective ones of said first sorting outlets;

g) preparing the sorting machine for a third sorting cycle for sorting the mailpieces, the preparation consisting in:

g.1 allocating the M×P first sorting outlets of the sorting machine to respective ones of the M×P third delivery destinations associated with the M second mail handling centers; and in g.2 re-circulating into the inlet of the sorting machine the mailpieces received in the third sorting outlet during the first sorting cycle; and e) subjecting said re-circulated mailpieces to the third sorting cycle in the sorting machine so as to collect, in each storage bin being filled at each first sorting outlet, mailpieces corresponding to a third delivery destination, these mailpieces that correspond to a third delivery destination being separated from the mailpieces that correspond to a second delivery destination by a separator in said storage bin.

It is thus possible to understand that, in this sorting process, each mailpiece is re-circulated into the machine not more than once, thereby contributing to reducing the risks of the mail being damaged, in addition to limiting the costs of using the machine.

In addition, the sorting segment can be subdivided optimally when the magnitude P is determined on the basis of the ratio N/M, with the condition that N−M×P remains greater than 1. In practice, the magnitude P is determined in an existing machine having a number of sorting outlets that is predefined. The magnitude P may thus be adjusted so that the mailpieces are, in principle, re-circulated once only. When the number of delivery destinations is too large for the number of sorting outlets available in the sorting machine, the method of the invention can be adapted to use, over repeated sorting cycles, the second sorting outlet, for example. However, it is also possible to subdivide the batch of mailpieces into a plurality of sub-sets, and to implement the method of the invention on each sub-set of mailpieces.

BRIEF DESCRIPTION OF THE DRAWINGS

An example of an implementation of the optimization method of the invention is shown by the drawings, and is described below in more detail. In the drawings.

DESCRIPTION OF IMPLEMENTATIONS

Figure 1:
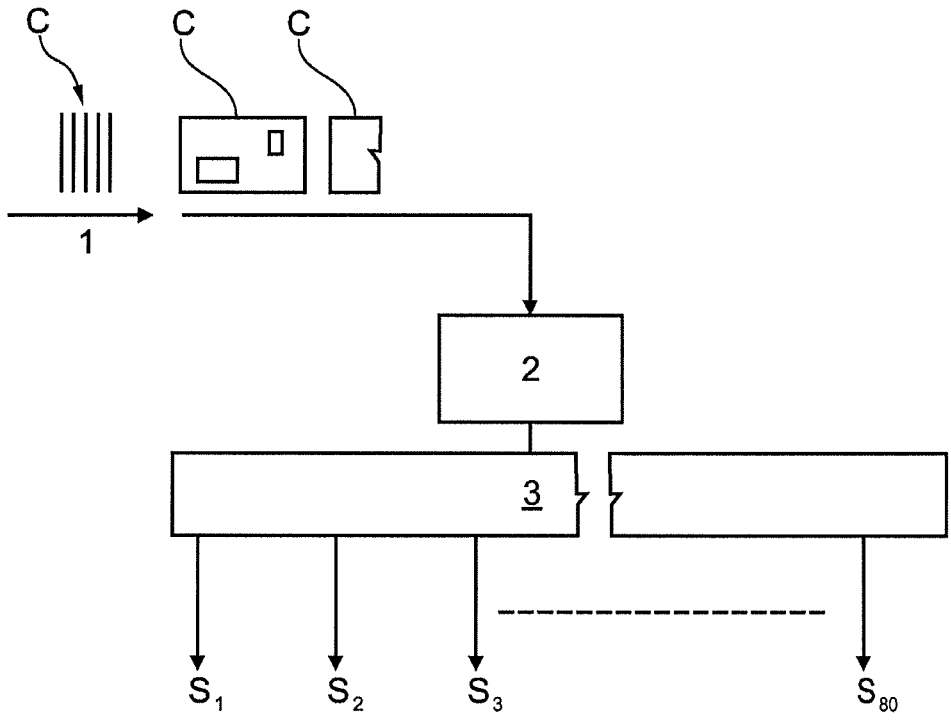
FIG. 1 diagrammatically shows a sorting machine having sorting outlets.

The postal sorting machine shown in FIG. 1 is conventional per se. It includes an inlet with an unstacker magazine 1 into which mailpieces C are inserted and placed in a stack on edge. The mailpieces C are unstacked and put into series one behind the other, e.g. with a pitch (spacing between the leading edges of two consecutive mailpieces) that is constant in a sorting conveyor 3 along the path of which an automatic address recognition system 2 is provided for automatically recognizing postal addresses. Each mailpiece is then directed by the sorting conveyor 3 towards a sorting outlet $S_1, S_2, S_3, \ldots, S_{80}$ as is well known. In the example, the sorting machine has eighty sorting outlets that use interchangeable or removable bins in which the mailpieces are stored flat.

Figure 2:
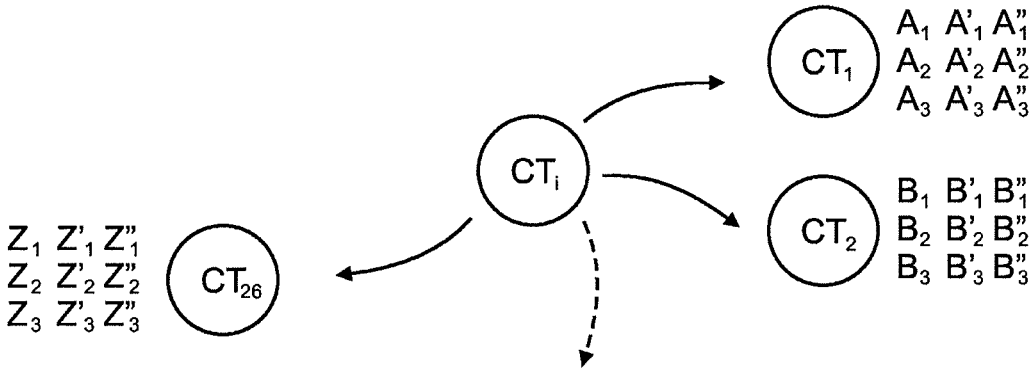
FIG. 2 diagrammatically shows a configuration of a postal sorting cluster having an outward sorting center and a plurality of inward sorting centers, which outward and inward sorting centers are in mutual communication with one another.

FIG. 2 shows a postal sorting cluster with twenty-six mail handling centers referenced CT. It is understood that the method of the invention is applicable to postal sorting clusters that are smaller or larger.

In order to simplify the description of the implementation of the optimization method of the invention, it is assumed below that the center referenced $CT_i$ is an outward sorting center that is in communication with twenty-five inward other sorting centers (the center $CT_i$ also itself constituting an inward sorting center). In FIG. 2, only three other inward sorting centers are shown, namely $CT_1$, $CT_2$, and $CT_{26}$, for reasons of clarity of the figure.

For the purposes of illustrating implementation of the method of the invention, consideration is thus given to outward sorting in the center $CT_i$ with a sorting machine having N=80 sorting outlets. In order to perform an outward sorting process over M=26 directions (corresponding to the twenty-six delivery sorting centers of the cluster), a segmentation pitch P for segmentation of the N sorting outlets of the machine is defined using the relationship P=integer value (N/M), i.e. P=3.

With this segmentation pitch, there remain two reserve outlets in the postal sorting machine, and, for each direction, it is thus possible to use three sorting outlets for pre-sorting three delivery destinations per inward sorting center.

For the purposes of illustrating implementation of the method of the invention, it is considered that the number of delivery destinations in each inward sorting center is a multiple of the segmentation pitch P, and, in the example shown, it is considered that there are nine delivery destinations for each direction. The term "delivery destination", should be understood to mean a group of delivery addresses that can correspond to one or more delivery rounds.

Thus, for the postal center $CT_1$, nine destinations $A_1, A_2, A_3, A'_1, \ldots, A''_3$ are shown, in which $A_1, A_2, A_3$ are main destinations having high filling rates representing most (e.g. 80%) of the volume of mail, $A'_1$, $A'_2$, $A'_3$ are destinations related to the destinations $A_1$, $A_2$, $A_3$ and having lower filling rates representing a smaller volume of mail (e.g. in the range 10% of the mail to 20% thereof), and the destinations $A''_1$, $A''_2$, $A''_3$ are destinations related to the destinations $A_1$, $A_2$, $A_3$ and having even lower filling rates, representing an even smaller volume of mail (e.g. less than 10%). The same representation of the delivery destinations is used for $CT_2$ with the destinations $B_1$, $B_2$, . . . , $B''_3$ and for $CT_{26}$ with the destinations $Z_1$, $Z_2$, $Z''_3$.

The basic idea of the invention is thus to pre-sort, overall, 9×26=234 delivery destinations with a sorting machine having 80 sorting outlets, while limiting the number of sorting cycles and also while optimizing the level of filling of the sorting outlet bins so as to limit the presence of partially filled bins at the end of the outward sorting process.

Figure 3:
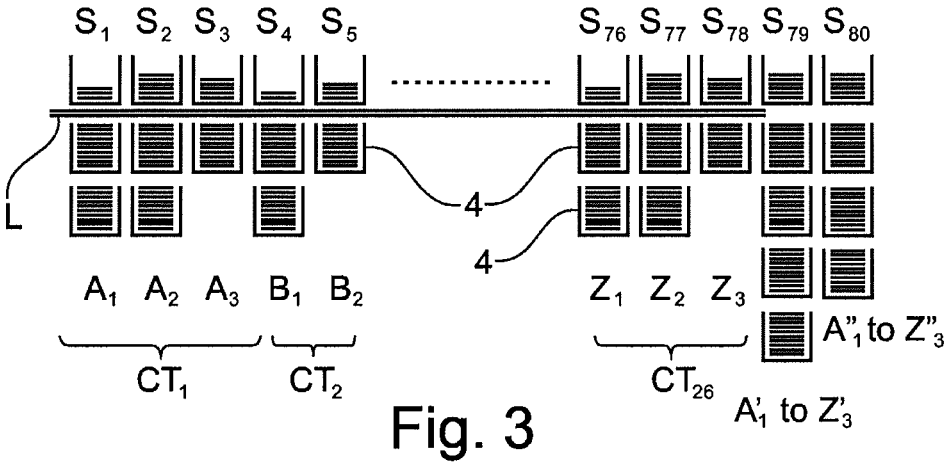
FIG. 3 diagrammatically shows an allocation of the sorting outlets of the machine for a first sorting cycle using the method of the invention.
Figure 4:
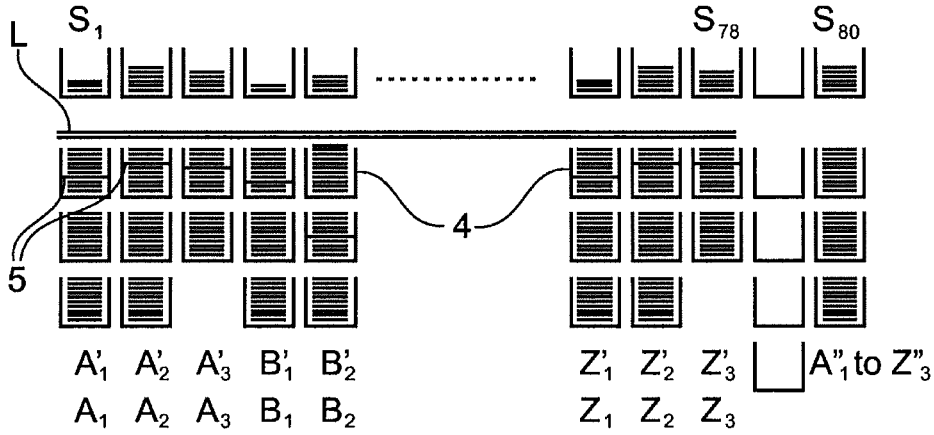
FIG. 4 diagrammatically shows another allocation of the sorting outlets of the machine for a second sorting cycle using the method of the invention.
Figure 5:
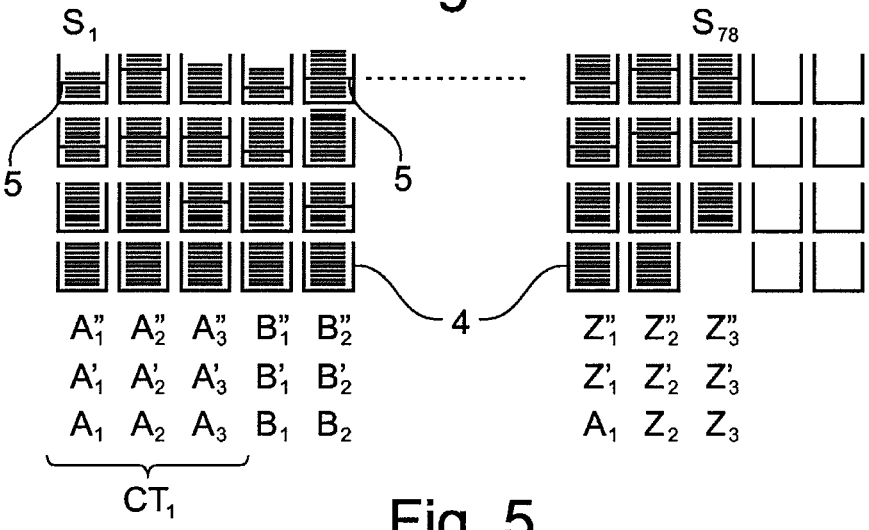
FIG. 5 diagrammatically shows yet another allocation of the sorting outlets for a third sorting cycle using the method of the invention.
Figure 6:
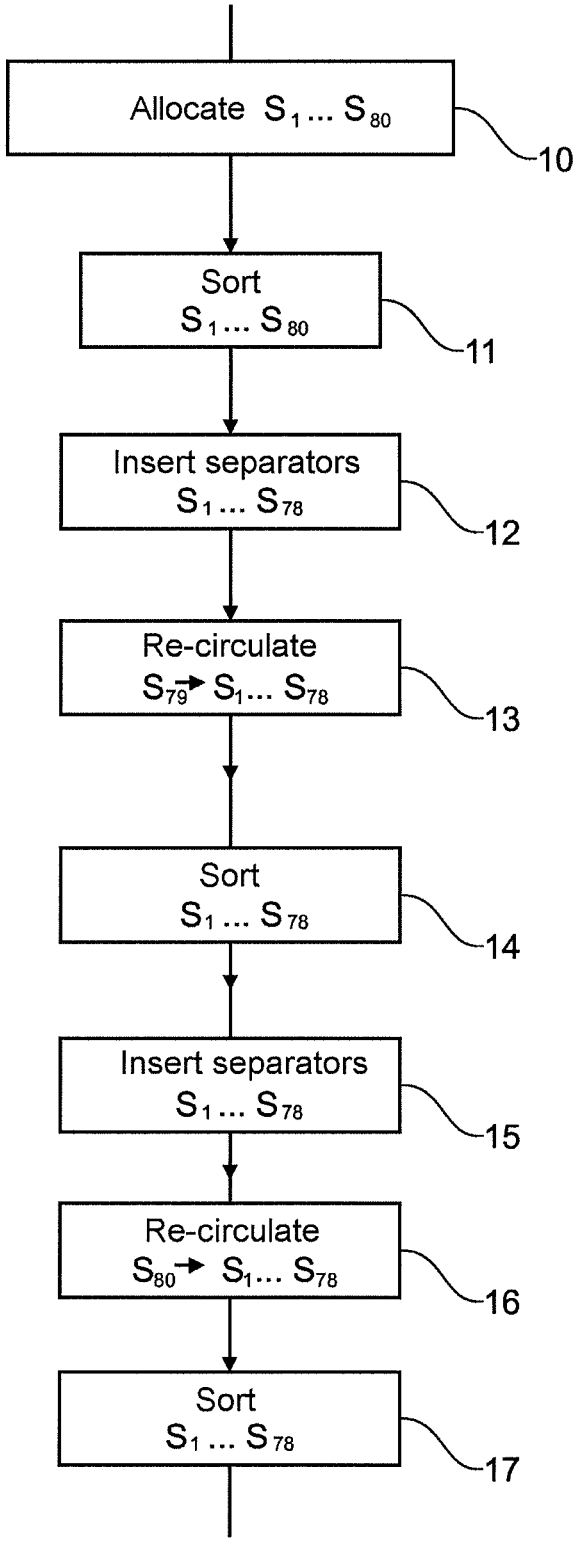
FIG. 6 diagrammatically shows the main steps of the optimization method of the invention.

FIGS. 3 to 5 together with FIG. 6 illustrate the main steps of the method of the invention.

In accordance with the invention, the outward sorting process starts with a step 10 (in FIG. 6) of parameterizing the sorting machine so as to prepare a first sorting cycle. In this step 10, other sorting cycles subsequent to the first sorting cycle can also be prepared.

In step 6, and as shown in FIG. 3, for the first sorting cycle, the sorting outlets $S_1$, $S_2$, $S_3$ are allocated to respective ones of the delivery destinations $A_1$, $A_2$, $A_3$. The sorting outlets $S_4$, $S_5$, $S_6$ are allocated to respective ones of the delivery destinations $B_1$, $B_2$, $B_3$, etc. up to the sorting outlets $S_{76}$, $S_{77}$, $S_{78}$ allocated to the delivery destinations $Z_1$, $Z_2$, $Z_3$.

Overall, the step 10 thus consists in allocating P (where P is greater than 1) successive sorting outlets (in the example, P is equal to 3) to the first P delivery destinations of each direction representing the largest volume of mail, the P sorting outlets allocated to one direction naturally being distinct from the P sorting outlets allocated to another direction, as is visible in FIG. 3.

In addition, the reserve sorting outlet $S_{79}$ is allocated to the next P delivery destinations (in the order corresponding to a decreasing volume of mail) for all of the directions, i.e., in this example, to $A'_1$, $A'_2$, $A'_3$, $B'_1$, $B'_2$, $B'_3$, . . . , $Z'_3$.

In addition, the reserve outlet $S_{80}$ is allocated to the next P delivery destinations (in this order corresponding to a decreasing volume of mail) for all of the directions, i.e., in this example, to $A''_1$, $A''_2$, $A''_3$, . . . , $Z''_3$.

Therefore, the above allocation of the sorting outlets in the first sorting cycle results in the flow of mail being separated over a large first sorting zone ($S_1$ to $S_{78}$) that receives most of the mail (e.g. 80% of the total volume of mail to be separated), over a small sorting zone ($S_{79}$) that receives a much smaller percentage of the mail (e.g. approximately in the range 10% of the volume to 20% thereof) and over a third sorting zone ($S_{80}$) that receives the remainder of the mail, i.e. less than 10% of the volume. Naturally, the proportions 80%, 20%, and 10% are given by way of example that is not limiting on the invention.

The outward sorting process continues in a sorting step 11 in which the mailpieces are subjected to the first sorting cycle in the machine, and said mailpieces are thus sorted and collected in the sorting outlet bins 4 shown in FIG. 3. The line L in FIG. 3 symbolizes a system for automatically manipulating full bins and empty bins, which system serves the sorting outlets as is well known. The bins being filled in the sorting outlets are disposed on top of the line L while the full bins of mailpieces, which bins have been extracted from the sorting outlets, are disposed under the line L. In addition, the bins associated with a particular sorting outlet are arranged in a column under said sorting outlet.

The sorting process continues in step 12 with storage bin separators 5 being inserted, which separators are placed in a stack at the inlet 1 of the machine, and then with the sorting machine being caused to direct each separator 5 into a respective bin 4 that is being filled and that is present in a sorting outlet of the first sorting segment, namely $S_1$ to $S_{78}$ as shown in FIG. 4.

The sorting process then continues in step 13 with the mailpieces stored in the bins of the reserve outlet $S_{79}$ (second zone of the sorting segment) being re-circulated into the inlet of the machine for a second sorting cycle performed on these mailpieces.

Provision may be made for the machine to be parameterized in the above step 10 as indicated above, for the purposes of allocating the sorting outlets for the second sorting cycle. Allocating the sorting outlets in the second sorting cycle consists in allocating the sorting outlets $S_1$, $S_2$, . . . , $S_{78}$ (of the main sorting segment) to the delivery destinations $A'_1$, $A'_2$, $A'_3$, $B'_1$, $B'_2$, $B'_3$, . . . , $Z'_2$, $Z'_3$, as shown in FIG. 4. Thus, for each destination, P consecutive sorting outlets of the first sorting segment are allocated to the P first related destinations of this direction.

The mailpieces taken from the outlet $S_{79}$ and re-circulated into the inlet of the machine are thus subjected (step 14 in FIG. 6) in the sorting machine to the second sorting cycle so as to be sorted into the sorting outlets $S_1$ to $S_{78}$ as shown in FIG. 4. At the end of this sorting cycle, new bins 4 full of mailpieces are produced by the sorting outlets $S_1$ to $S_{78}$ and bins 4 are being filled in said sorting outlets.

The process then continues again with a step 15 of inserting separators 5 into the inlet of the sorting machine and of causing the machine to direct each of said separators to a partially full storage bin at each sorting outlet $S_1$ to $S_{78}$, as shown in FIG. 5.

The sorting process then continues in step 16 with the mailpieces stored in the bins of the reserve outlet $S_{80}$ (third zone of the sorting segment) being re-circulated into the inlet of the machine for a third sorting cycle on these mailpieces. FIG. 5 shows the third sorting cycle. In this third sorting cycle, the sorting outlets $S_1$ to $S_{78}$ are allocated to the delivery destinations $A''_1$, $A''_2$, $A''_3$, $B''_1$, $B''_2$, . . . , $Z''_1$, $Z''_2$, $Z''_3$. Thus, P consecutive sorting outlets P are allocated to the P second related destinations of each direction.

Finally, in step 17 (FIG. 6), the mailpieces taken from the reserve outlet $S_{80}$ and re-circulated into the inlet of the sorting machine are subjected to the third sorting cycle for sorting them into the sorting outlets $S_1$ to $S_{78}$ of the main sorting section.

At the end of step 17, the outward sorting process is finished. As can be seen in FIG. 5, for each sorting outlet $S_1$ to $S_{78}$ of the main sorting segment, a certain number of bins 4 of mailpieces have been produced, including a single partially full bin. For each direction such as $CT_1$, at the most three partially full bins are produced over all of the bins filled with mailpieces and corresponding to each direction. In addition, the mailpieces corresponding to the various delivery destinations such as $A_1$, $A'_1$, $A''_2$ are distinguished between in the bins by separators 5, thereby making it easy, during the subsequent inward sorting, to extract the mailpieces from the bins while maintaining the order of the pre-sorting achieved during the outward sorting.

It should be noted that, during the various sorting cycles of the sorting process, a signage label may be affixed to each bin that includes a separator serving to separate two layers of mailpieces so that such separation is easily identifiable by a machine operator during the inward sorting.

In a conventional sorting process, the proportion of partially full bins may be as high as about 25% of all of the bins produced by the outward sorting. The method of the invention for optimizing the outward sorting process makes it possible to reduce this proportion to about 9%, thereby contributing to reducing the costs of transporting the mailpieces between the various sorting centers of a cluster.

The segmentation pitch P of the sorting outlets depends, in principle, on the number of sorting outlets available in the sorting machine, on the number of delivery destinations to cover, and on the number of mail handling centers to serve. The segmentation of the sorting outlets in the above example corresponds to maximum operating efficiency for a sorting machine having 80 sorting outlets for sorting 234 delivery destinations distributed over 26 postal sorting centers.

The invention claimed is:

1. A method of optimizing a process for handling mail in a sorting machine, said method comprising the following steps:

subjecting mailpieces to a first machine-sorting cycle in which a plurality of first sorting outlets of the sorting machine are allocated to respective ones of a plurality of first delivery destinations and at least one other sorting outlet of the sorting machine is allocated to a plurality of second delivery destinations;

inputting separators into an inlet of the sorting machine for physically separating mailpieces through the sorting machine to respective ones of the first sorting outlets;

re-circulating to the inlet of the sorting machine the mailpieces coming from said other sorting outlet; and subjecting them to a second sorting cycle in which the plurality of first sorting outlets are allocated to respective ones of the plurality of second delivery destinations.

2. A method according to claim 1, wherein mailpieces are collected and sorted in a first mail handling center so as to be transported in storage bins to M second mail handling centers in communication with the first mail handling center, the sorting of the mail in the first center comprising separating the mailpieces in a sorting machine having N sorting outlets, each of which uses at least one storage bin so as o form M groups of storage bins in which the mailpieces are stored, these M groups of storage bins being for respective ones of said M second mail handling centers, and wherein the sorting machine is controlled by one or more sorting cycles so as to segment each group of storage bins for a second mail handling center in such a manner as to distinguish between the mailpieces stored in said bins depending on a plurality of delivery destinations associated with said second mail handling center, said method further comprising the following steps:

a) preparing the sorting machine for a first sorting cycle for sorting the mailpieces, the sorting outlets of the sorting machine comprising a plurality of first sorting outlets and at least one second sorting outlet distinct from said first sorting outlets, the preparation comprising:

a.1) allocating P first sorting outlets to respective ones of P first delivery destinations associated with a second mail handling center in question, and doing so for each second mail handling center with the condition M×P less than N, where P is greater than 1, the P first sorting outlets allocated to a second center being distinct from the P first sorting outlets allocated to another second mail handling center; and a.2) allocating said second sorting center to M×P second delivery destinations associated with respective ones of M second mail handling centers;

b) subjecting the mailpieces to the first sorting cycle in the sorting machine so as to collect, in at least one storage bin at each first sorting outlet, mailpieces corresponding to a first delivery destination associated with a second mail handling center and, at the second sorting outlet, mailpieces corresponding to the M×P second delivery destinations;

c) inputting into the sorting machine M×P separators so as to place them in respective ones of the M×P storage bins being filled at respective ones of said first sorting outlets;

d) preparing the sorting machine for a second sorting cycle for sorting the mailpieces, the preparation comprising:

d.1) allocating the M×P first sorting outlets of the sorting machine to respective ones of the M×P second delivery destinations associated with the M second mail handling centers; and d.2) re-circulating into the inlet of the sorting machine the mailpieces received in the second sorting outlet during the first sorting cycle; and e) subjecting said re-circulated mailpieces to the second sorting cycle in the sorting machine so as to collect, in each storage bin being filled at each first sorting outlet, mailpieces corresponding to a second delivery destination, these mailpieces that correspond to a second delivery destination being separated from the mailpieces that correspond to a first delivery destination by a separator in said storage bin.

3. A method according to claim 2, wherein said sorting outlets include a third sorting outlet that is distinct from said first and second sorting outlets, wherein, in step a.2), the preparation further comprises allocating the third sorting outlet to M×P third delivery destinations associated with respective ones of the M second mail handling centers, wherein, in step b), the mailpieces are subjected to the first sorting cycle so as to collect, at said third sorting outlet, the mailpieces corresponding to the M×P third delivery destinations, and wherein the method further comprises the following steps, subsequent to step e):

f) inputting into the sorting machine M×P other separators so as to place them in respective ones of the M×P storage bins being filled at respective ones of the said first sorting outlets;

g) preparing the sorting machine for a third sorting cycle for sorting the mailpieces, the preparation consisting in:

g.1) allocating the M×P first sorting outlets of the sorting machine to respective ones of the M×P third delivery destinations associated with the M second snail handling centers; and in g.2) re-circulating into the inlet of the sorting machine the mailpieces received in the third sorting outlet during the first sorting cycle; and h) subjecting said re-circulated mailpieces to the third sorting cycle in the sorting machine so as to collect, in each storage bin being filled at each first sorting outlet, mailpieces corresponding to a third delivery destination, these mailpieces that correspond to a third delivery destination being separated from the mailpieces that correspond to a second delivery destination by a separator in said storage bin.

4. A method according to claim 2, wherein the magnitude P is determined on the basis of the ratio N/M.

5. A method of optimizing a process for handling mail in a sorting machine, said method comprising the following steps:

subjecting mailpieces to a first chine-sorting cycle in which a plurality of first sorting outlets of the sorting machine are allocated to respective ones of a plurality of first delivery destinations and at least one other sorting outlet of the sorting machine is allocated to a plurality of second delivery destinations;

directing separators for physically separating mailpieces through the sorting machine to respective ones of the first sorting outlets;

re-circulating to the inlet of the sorting machine the mailpieces coming from said other sorting outlet; and subjecting them to a second sorting cycle in which the plurality of first sorting outlets are allocated to respective ones of the plurality of second delivery destinations, wherein mailpieces are collected and sorted in a first mail handling center so as to be transported in storage bins to M second mail handling centers in communication with the first mail handling center, the sorting of the mail in the first center comprising separating the mailpieces in a sorting machine having N sorting outlets, each of which uses at least one storage bin so as to form M groups of storage bins in which the mailpieces are stored, these M groups of storage bins being for respective ones of said M second mail handling centers, and wherein the sorting machine is controlled by one or more sorting cycles so as to segment each group of storage bins for a second mail handling center in such a manner as to distinguish between the mailpieces stored in said bins depending on a plurality of delivery destinations associated with said second mail handling center, said method further comprising the following steps:

a) preparing the sorting machine for a first sorting cycle for sorting the mailpieces, the sorting outlets of the sorting machine comprising a plurality of first sorting outlets and at least one second sorting outlet distinct from said first sorting outlets, the preparation comprising:

a.1) allocating P first sorting outlets to respective ones of P first delivery destinations associated with a second mail handling center in question, and doing so for each second mail handling center with the condition M×P less than N, where P is greater than 1, the P first sorting outlets allocated to a second center being distinct from the P first sorting outlets allocated to another second mail handling center; and a.2) allocating said second sorting center to M×P second delivery destinations associated with respective ones of M second mail handling centers;

b) subjecting the mailpieces to the first sorting cycle in the sorting machine so as to collect, in at least one storage bin at each first sorting outlet, mailpieces corresponding to a first delivery destination associated with a second mail handling center and, at the second sorting outlet, mailpieces corresponding to the M×P second delivery destinations;

c) inputting into the sorting machine M×P separators so as to place them in respective ones of the M×P storage bins being filled at respective ones of said first sorting outlets;

d) preparing the sorting machine for a second sorting cycle for sorting the mailpieces, the preparation comprising:

d.1) allocating the M×P first sorting outlets of the sorting machine to respective ones of the M×P second delivery destinations associated with the M second mail handling centers; and d.2) re-circulating into the inlet of the sorting machine the mailpieces received in the second sorting outlet during the first sorting cycle; and e) subjecting said re-circulated mailpieces to the second sorting cycle in the sorting machine so as to collect, in each storage bin being filled at each first sorting outlet, mailpieces corresponding to a second delivery destination, these mailpieces that correspond to a second delivery destination being separated from the mailpieces that correspond to a first delivery destination by a separator in said storage bin.

6. A method according to claim 5, wherein said sorting outlets include a third sorting outlet that is distinct from said first and second sorting outlets, wherein, in step a.2), the preparation further comprises allocating the third sorting outlet to M×P third delivery destinations associated with respective ones of the M second mail handling centers, wherein, in step b), the mailpieces are subjected to the first sorting cycle so as to collect, at said third sorting outlet, the mailpieces corresponding to the M×P third delivery destinations, and wherein the method further comprises the following steps, subsequent to step e):

f)inputting into the sorting machine M×P other separators so as to place them in respective ones of the M×P storage bins being filled at respective ones of the said first sorting outlets;

g) preparing the sorting machine for a third sorting cycle for sorting the mailpieces, the preparation consisting in:

g.1) allocating the M×P first sorting outlets of the sorting machine to respective ones of the M×P third delivery destinations associated with the M second mail handling centers; and in g.2) re-circulating into the inlet of the sorting machine the mailpieces received in the third sorting outlet during the first sorting cycle; and h) subjecting said re-circulated mailpieces to the third sorting cycle in the sorting machine so as to collect, in each storage bin being filled at each first sorting outlet, mailpieces corresponding to a third delivery destination, these mailpieces that correspond to a third delivery destination being separated from the mailpieces that correspond to a second delivery destination by a separator in said storage bin.

7. A method according to claim 5, wherein the magnitude P is determined on the basis of the ratio N/M.

* * * * *